US008076558B1

(12) United States Patent
Huang

(10) Patent No.: US 8,076,558 B1
(45) Date of Patent: Dec. 13, 2011

(54) REINFORCED MUSIC BOX

(75) Inventor: Lung-Hsi Huang, Dali (TW)

(73) Assignee: Kyooh Precision Industry Co., Ltd., Taichung (TW)

( * ) Notice: Subject to any disclaimer, the term of this patent is extended or adjusted under 35 U.S.C. 154(b) by 57 days.

(21) Appl. No.: 12/813,625

(22) Filed: Jun. 11, 2010

(51) Int. Cl.
*G10F 1/06* (2006.01)

(52) U.S. Cl. ..... 84/95.1

(58) Field of Classification Search ..... 84/94.1, 84/94.2, 95.1, 95.2, 96–101
See application file for complete search history.

(56) References Cited

U.S. PATENT DOCUMENTS 6,323,404 B1 * 11/2001 Hayashi ..... 84/94.1

* cited by examiner

*Primary Examiner* — Kimberly Lockett
(74) *Attorney, Agent, or Firm* — Chun-Ming Shih

(57) ABSTRACT

A reinforced music box includes a base portion, a two-sided cogwheel, a step type cogwheel, a music generator, a cover portion and a friction set. The two-sided cogwheel is disposed in the base portion and may rotate axially. The cover portion has a main part, a friction part and a supporting part. The main part, friction part and supporting part are integrally formed and either the main part or supporting part has a plurality of engagement holes that can engage with the fixing protrusions of the base portion. The friction set has a friction part and a spirally cogged stick. The spirally cogged stick may engage with the second cogwheel of the two-sided cogwheel at 90 degree. Therefore, the cover portion, which is integrally formed, may provide better protection and the cost in manufacturing and assembly may be reduced.

7 Claims, 6 Drawing Sheets

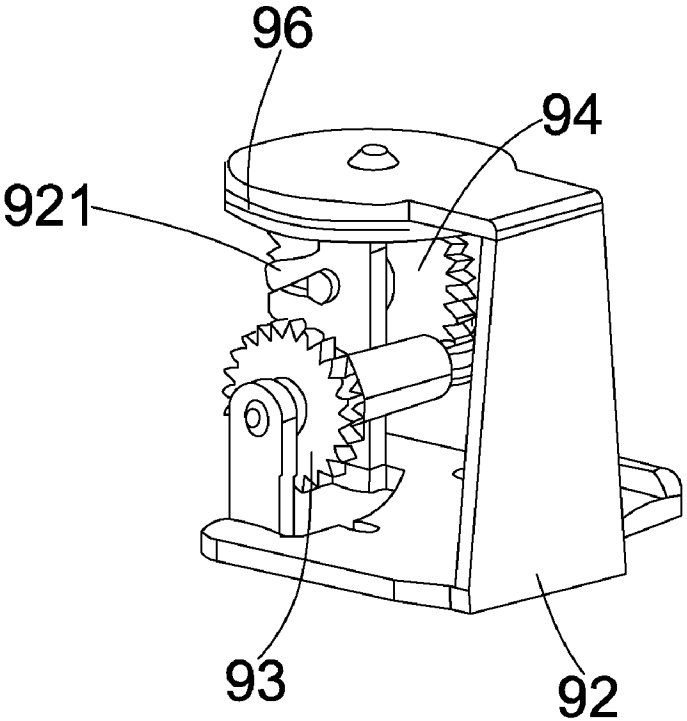
FIG.4
Prior Art
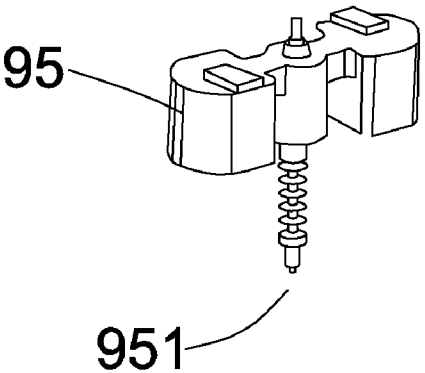

REINFORCED MUSIC BOX

BACKGROUND OF THE INVENTION

1. Field of the Invention

The invention generally relates to a music box. More particularly, the invention relates to a reinforced music box.

2. Description of the Prior Art

Please see FIGS. 1 and 2, which illustrate a conventional music box. The music box comprises a base portion 1, a two-sided cogwheel 2, a step type cogwheel 3, a friction set 4 and a cover portion 5. The two-sided cogwheel 2 and step type cogwheel 3 are disposed in slots provided on the base portion 1 and they are arranged in a parallel manner. They may engage with each. Also, the step type cogwheel 3 engages with a cogwheel set 6 disposed on the base portion 1. The cogwheel set 6 engages with the two-sided cogwheel 2. The cover portion 5 can limit the range of motion of the step type cogwheel 3, two-sided cogwheel 2 and friction set 4. Such music box has the following disadvantages:

(1) Because the thin and fragile spirally cogged stick is not protected, it may be easily damaged or deformed during the assembly or delivery.

(2) Because the cover portion 5 is made of plastic, the motion of the step type cogwheel 3 and cogwheel set 6 produces an upward force, which may cause the cover portion 5 to deform. The deformation may affect the normal range of motion of the step type cogwheel 3.

Please refer to FIGS. 3 and 4, which illustrate another type of conventional music box. A supporting portion 92 is additionally provided and is disposed on top of the base portion 91. The supporting portion 92 is made by an iron plate. A two-sided cogwheel 93 and a step type cogwheel 94 are made of polyformaldehyde (POM). In assembly, the two-sided cogwheel 93 and step type cogwheel 94 are fitted on top of a rack 921 of the supporting portion 92 and they are arranged in a parallel manner. Then stamping is used to connect them. Such music box has the following disadvantages:

(1) Because the supporting portion 92 is made by an iron plate, the stamping would give it rough edges. These rough edges may affect the normal range of motion of the two-sided cogwheel 93 and step type cogwheel 94 and may even accelerate the wear of the cogwheels.

(2) Because the supporting portion 92 has to undergo galvanization, the galvanization may easily cause it to deform. This deformation may affect the precision in assembly for the two-sided cogwheel 93 and step type cogwheel 94 (may even cause difficulty in assembly).

(3) Because pressing is used for the rack 921 of the supporting portion 92, the result of the pressing is often either to tight or too loose. Such result adversely affects the overall structure and the transmission between the cogwheels.

(4) A friction board 96 is additionally provided on the supporting portion 92. Because pressing is needed to connect the friction board 96 with the supporting portion 92, which is made of iron, hence labor cost is enhanced.

From the above, we can see that improvements are needed for the conventional music boxes in terms of material cost, manufacturing process, labor cost and the precision in assembly.

SUMMARY OF THE INVENTION

An object of the present invention is to provide a reinforced music box that requires less cost and labor in production and that can simplify manufacturing.

Another object of the present invention is to provide a reinforced music box that does not requires any galvanization and hence electricity may be saved and deformation in the galvanization may be avoided.

A third object of the present invention is to provide a reinforced music box that has a higher degree of precision in assembly.

A fourth object of the present invention is to provide a reinforced music box that has an enhanced protection for the spirally cogged stick (to protect it from bending).

To reach these objects, the reinforced music box of the present invention is disclosed. The reinforced music box of the present invention comprises a base portion, a two-sided cogwheel, a step type cogwheel, a music generator, a cover portion and a friction set. The base portion has a lower hole and a plurality of fixing protrusions. The two-sided cogwheel is disposed in the base portion and may rotate axially. The step type cogwheel is disposed in the base portion and may engage with the first cogwheel of the two-sided cogwheel. The step type cogwheel may rotate axially and rotate along with the two-sided cogwheel. The music generator is disposed in the base portion and may generate music by the motion from the step type cogwheel. The cover portion has a main part, a friction part and a supporting part. The main part, friction part and supporting part are integrally formed and either the main part or supporting part has a plurality of engagement holes that can engage with the fixing protrusions of the base portion. The friction part has an upper hole. The friction set has a friction part and a spirally cogged stick. The upper end and lower end of the cogged stick are fitted to the upper hole of the cover portion and the lower hole of the base portion, respectively. The spirally cogged stick may engage with the second cogwheel of the two-sided cogwheel at 90 degree.

BRIEF DESCRIPTION OF THE DRAWINGS

The drawings disclose an illustrative embodiment of the present invention, which serves to exemplify the various advantages and objects hereof, and are as follows:

FIG. 4 is a view showing some components of the music box of FIG. 3.

DETAILED DESCRIPTION OF THE PREFERRED EMBODIMENT

Figure 1:
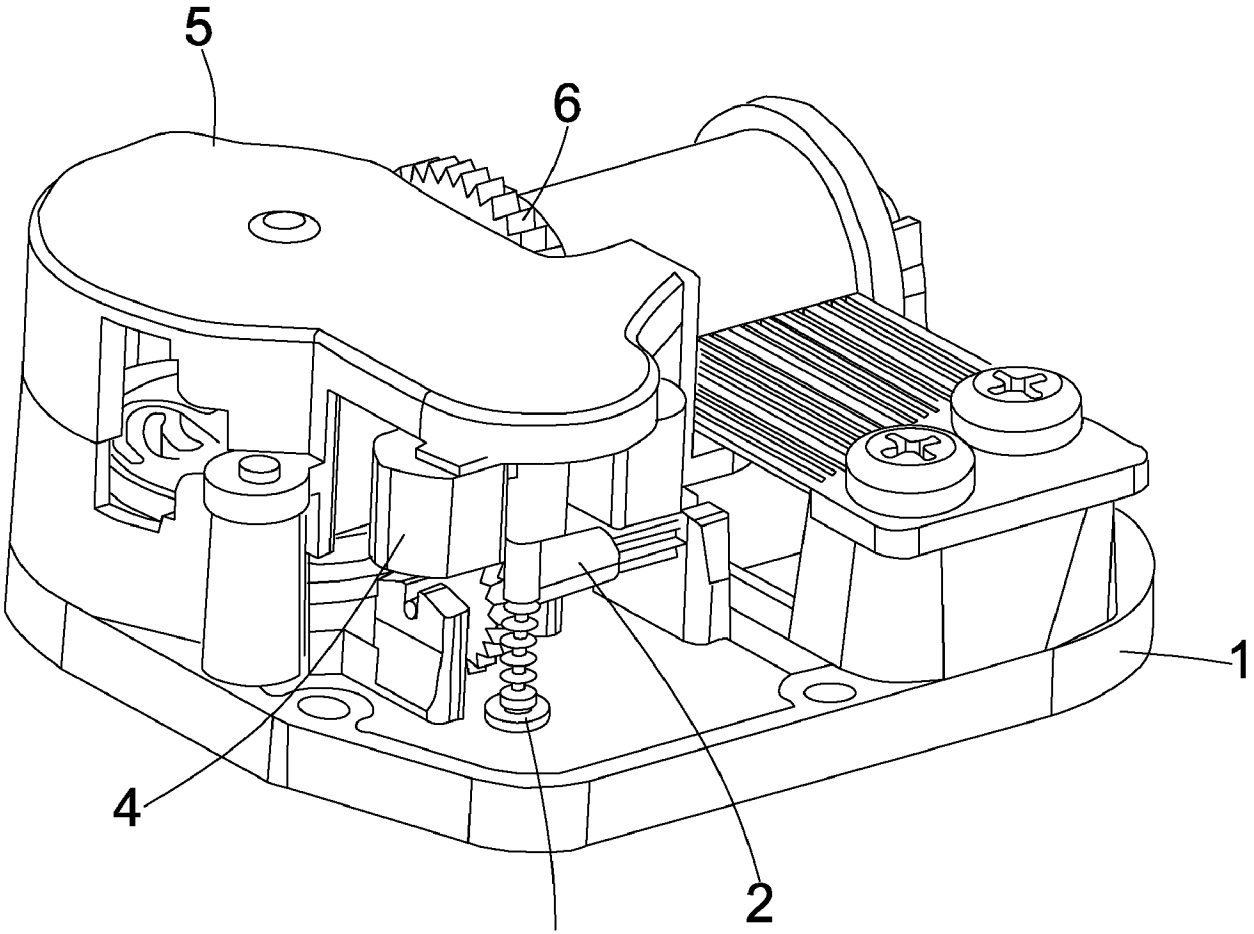
FIG.1 Prior Art
FIG. 1 is a perspective view of a conventional music box in an assembled condition.
Figure 2:
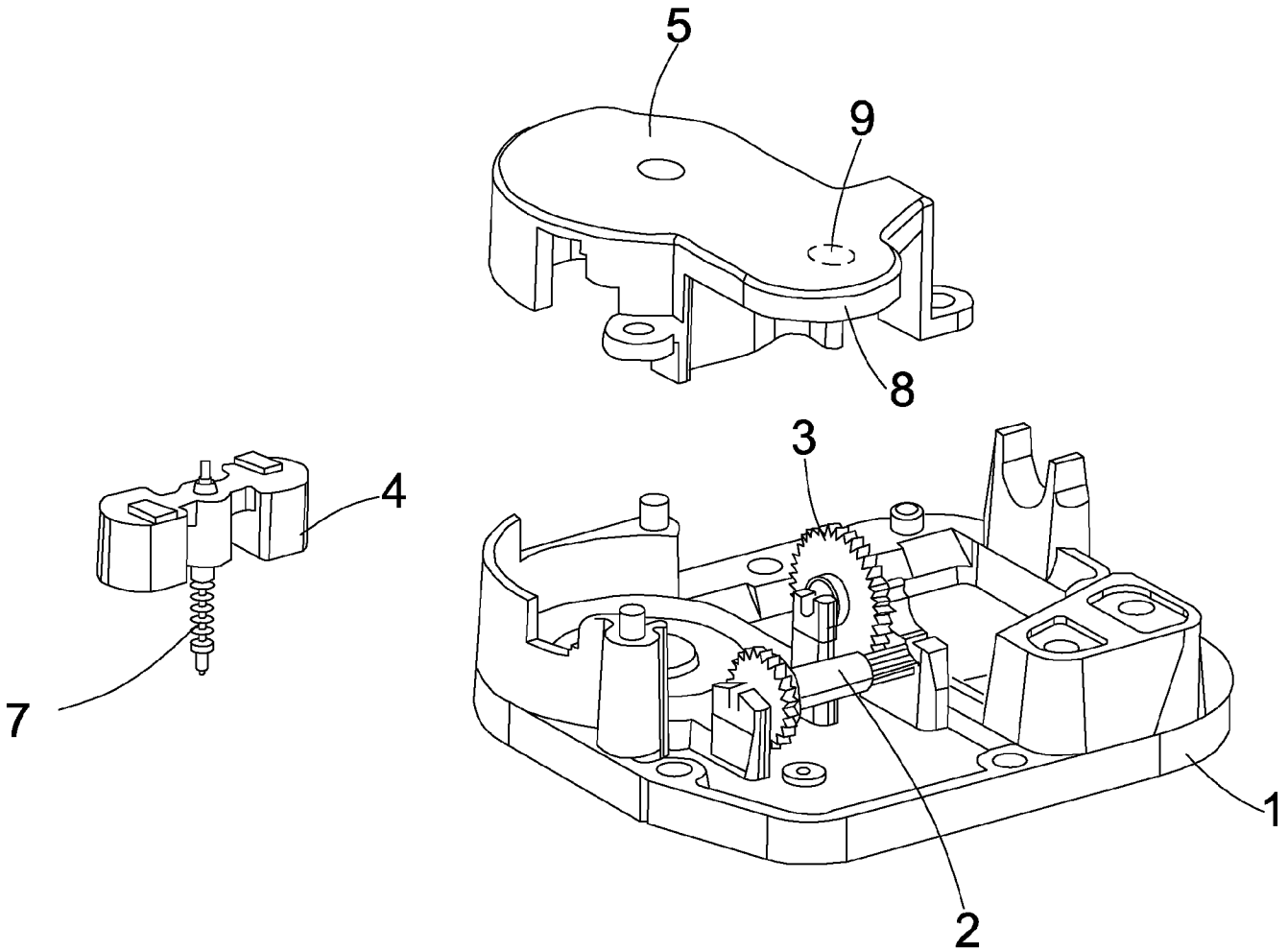
FIG.2 Prior Art
FIG. 2 is an exploded view of the music box of FIG. 1.
Figure 3:
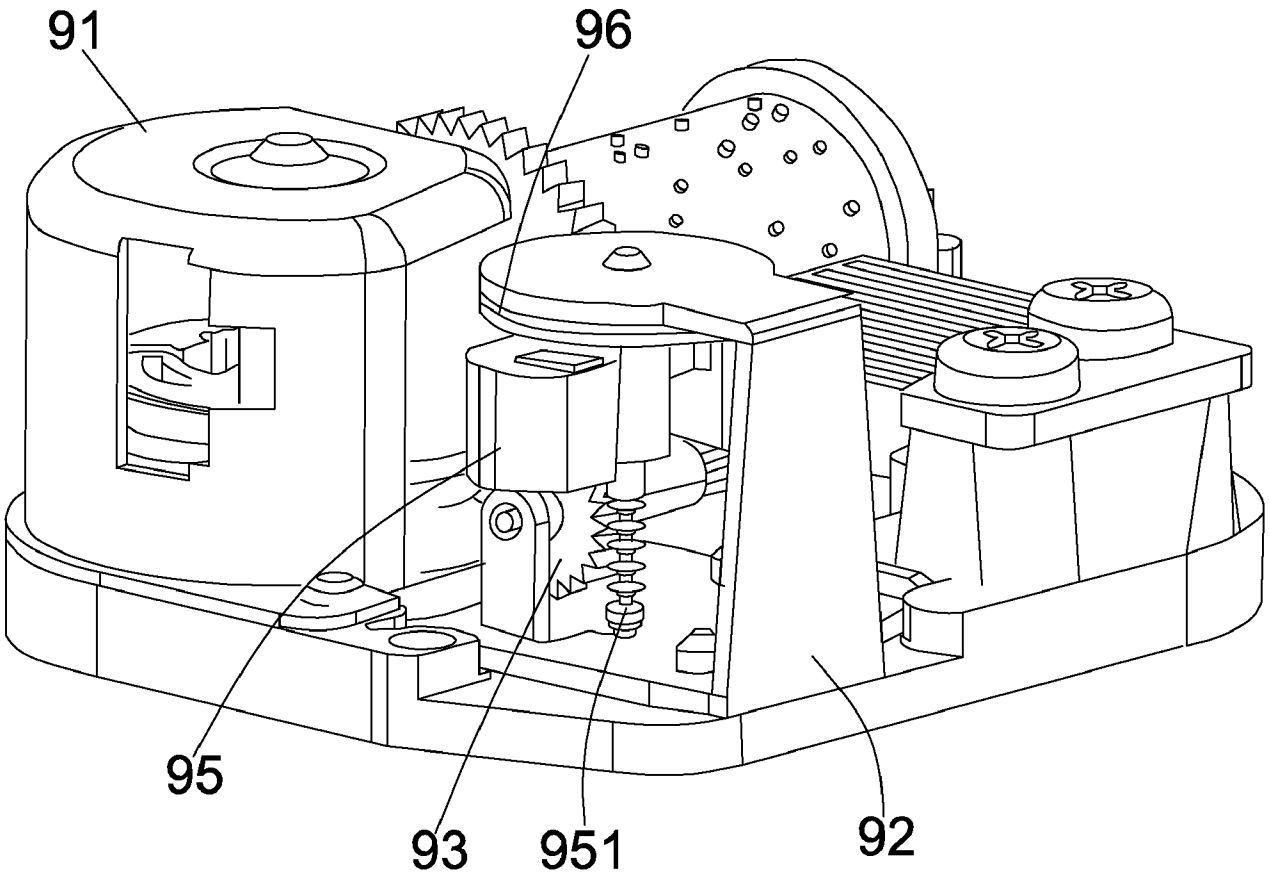
FIG.3 Prior Art
FIG. 3 is a perspective view of another type of conventional music box in an assembled condition.
Figure 5:
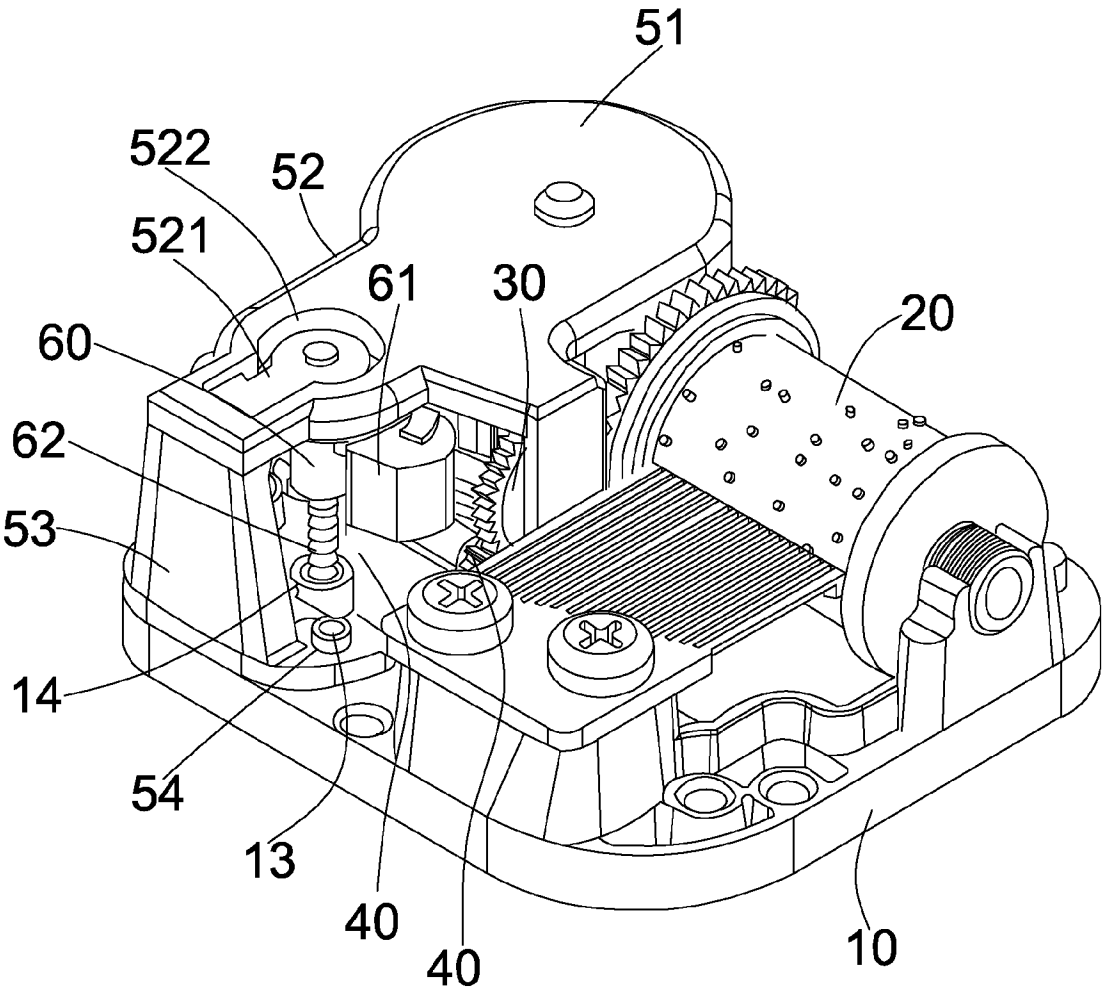
FIG. 5 is a perspective view of the reinforced music box of the present invention in an assembled condition.
Figure 6:
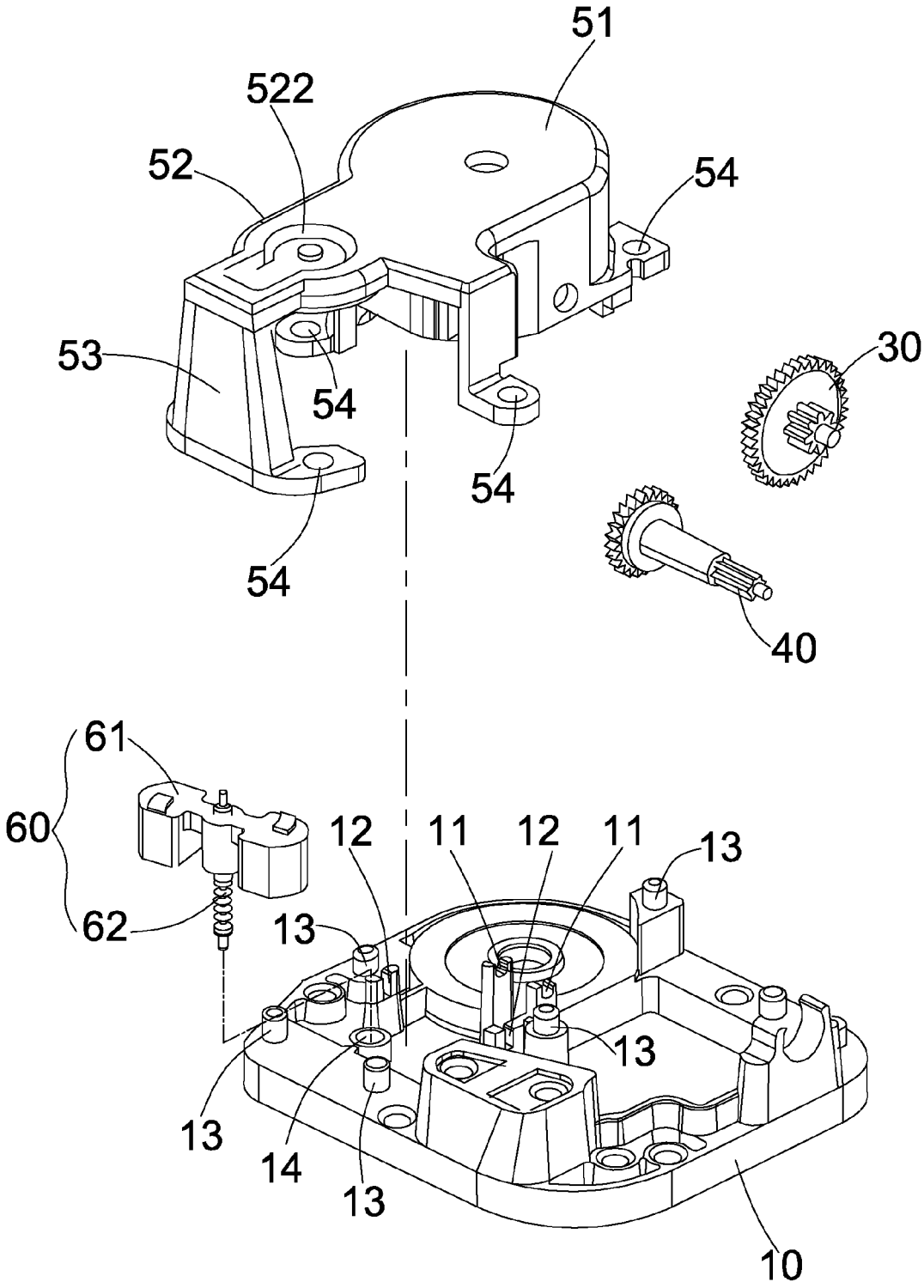
FIG. 6 is an exploded view of the reinforced music box of the present invention.

Please see FIGS. 5 and 6. The reinforced music box of the present invention comprises a base portion 10, a music generator 20, a step type cogwheel 30, a two-sided cogwheel 40, a cover portion 50 and a friction set 60.

The base portion 10 has two first position-limiting slots 11, two-second position limiting slots 12, a plurality of fixing protrusions 13 and a lower hole 14.

The music generator 20 is fitted to the base portion 10 and a user may rotate it to generate music.

The step type cogwheel 30 is fitted to the two first position-limiting slots 11 and its position is limited by the two first position-limiting slots 11. Therefore, the step type cogwheel 30 can rotate axially.

The two-sided cogwheel 40 is fitted to the two-second position limiting slots 11 and its position is limited by the two-second position limiting slots 11. Therefore, the cogwheel 30 can rotate axially. In addition, the first cogwheel of the two-sided cogwheel 40 may engage with the step type cogwheel 30.

The cover portion 50 has a main part 51, a friction part 52 and a supporting part 53. The cover portion 50 is made of POM and is integrally formed. The friction part 52 horizontally extends from the main part 51 and the supporting part 53 vertically extends from the friction part 52. Either the main part 51 or the supporting part 53 has a plurality of engagement holes 54. The engagement holes 54 may be aligned with the fixing protrusions 13 of the base portion 10 so that, through the connection of the engagement holes 54 and the fixing protrusions 13 (they are connected by pressing), the cover portion 50 may be fitted to the base portion 10. An indentation area 521 is centrally provided in the friction part 52 and an edge 522 is formed around the indentation area 521. Therefore, the indentation area 521 has a predetermined degree of flexibility. The height of the indentation area 521 is lower than that of the supporting part 53. An upper hole (not shown in the drawings) is formed in the opposite side of the indentation area 521.

The friction set 60 has a friction part 61 and a spirally cogged stick 62. The upper end and lower end of the cogged stick 62 are fitted to the upper hole of the cover portion 50 and the lower hole 14 of the base portion 10, respectively. In addition, the spirally cogged stick 62 may engage with the second cogwheel of the two-sided cogwheel 40 at 90 degree. In use, a user may rotate the spirally cogged stick 62 and then the rotation is passed onto the two-sided cogwheel 40 and step type cogwheel 30 and to the music generator 20, which can generate music.

The structure of a preferred embodiment 100 of the present invention and how it is assembled have been described. In comparison to the prior art, the present invention has the following advantages and features:

(1) In the reinforced music box of the present invention, the cover portion 50 is made of POM and is integrally formed and hence requires less cost, labor and time in the production (in the prior art, galvanization is used).

(2) The edge 522 formed around the indentation area 521 enables the indentation area 521 to have a certain degree of flexibility. In addition, the height of the indentation area 521 is lower than that of the supporting part 53. Therefore, as a bump or an external force exerts on the top surface of the cover portion 50, the top surface of the supporting part 53 and the indentation area 521 can protect the spirally cogged stick 62 from deformation or damage.

(3) Because the main part 51, friction part 52 and supporting part 53 are made of POM and are integrally formed, the cover portion 50 may be fixedly fitted on top of the base portion 10 and hence it is reinforced and strengthened and can withstand bumps. In addition, because the friction part 52 has a high degree of levelness, even friction between the friction unit 61 and the friction part 52 may be achieved as the music generator 20 sends out music. Therefore, noise level may be reduced.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A reinforced music box, comprising:

a base portion, having a lower hole and a plurality of fixing protrusions;

a two-sided cogwheel, disposed in the base portion and able to rotate axially;

a step type cogwheel, disposed in the base portion and may engage with a first side cogwheel of the two-sided cogwheel, wherein the step type cogwheel may rotate axially;

a music generator, disposed on the base portion and linked with the step type cogwheel, wherein the music generator may generate music;

a cover portion, having a main part, a friction part and a supporting part, wherein the main part, friction part and supporting part are integrally formed and either the main part or supporting part has a plurality of engagement holes that can engage with the fixing protrusions of the base portion, and wherein the friction part has an upper hole and an edge is formed around an indentation area, and wherein the indentation area has a predetermined degree of flexibility; and a friction set, having a friction part and a spirally cogged stick, wherein upper end lower end of the cogged stick are fitted to the upper hole of the cover portion and the lower hole of the base portion, respectively, and the cogged stick may perpendicularly engage with the second cogwheel of the two-sided cogwheel.

2. The reinforced music box as in claim 1, wherein the base portion has at least a first position limiting slot and the step type cogwheel is disposed in the first position limiting slot so that the step type cogwheel may rotate axially.

3. The reinforced music box as in claim 1, wherein the base portion has at least a second position limiting slot and the two-sided cogwheel is disposed in the second position limiting slot so that the two-sided cogwheel may rotate axially.

4. The reinforced music box as in claim 1, wherein the cover portion is made of polyformaldehyde (POM) and is integrally formed.

5. The reinforced music box as in claim 1, wherein the friction part horizontally extends from the main part and the supporting part vertically extends from the friction part.

6. The reinforced music box as in claim 1, wherein another indentation area is centrally provided in the friction part and another upper hole is formed on opposite side of the indentation area.

7. The reinforced music box as in claim 1, wherein a height of the indentation area is lower than that of the supporting part.

* * * * *